US006688152B2

(12) United States Patent
Klingen et al.

(10) Patent No.: US 6,688,152 B2
(45) Date of Patent: Feb. 10, 2004

(54) MODULAR DRAWING APPARATUS AND DRAWING

(75) Inventors: Hermann-Josef Klingen, Moers (DE); Norbert Zillekens, Hückelhoven (DE); Karl-Heinz Häusler, Korschenbroich (DE)

(73) Assignee: SMS Meer GmbH, Monchengladbach (DE)

( * ) Notice: Subject to any disclaimer, the term of this patent is extended or adjusted under 35 U.S.C. 154(b) by 0 days.

(21) Appl. No.: 10/143,726

(22) Filed: May 9, 2002

(65) Prior Publication Data

US 2002/0189314 A1 Dec. 19, 2002

(30) Foreign Application Priority Data

May 10, 2001 (DE) ..... 101 22 658

(51) Int. Cl.[7] ..... B21C 1/30

(52) U.S. Cl. ..... 72/291; 72/278; 72/290; 72/430; 72/442

(58) Field of Search ..... 72/252, 274, 278, 72/287, 290, 291, 301, 302, 311, 429, 430, 441, 442; 226/4, 108, 112, 158, 162

(56) References Cited

U.S. PATENT DOCUMENTS

| | | | | | |
|---|---|---|---|---|---|
| 3,881,339 | A | * | 5/1975 | Mannell | 72/257 |
| 5,419,480 | A | * | 5/1995 | Pratt | 226/108 |
| 5,771,727 | A | * | 6/1998 | Stinnertz et al. | 72/21.4 |
| 5,855,136 | A | * | 1/1999 | Hausler et al. | 72/291 |

FOREIGN PATENT DOCUMENTS

| | | |
|---|---|---|
| DE | 28 52 071 | 6/1980 |
| EP | 0 182 922 | 6/1986 |
| EP | 0 371 165 | 6/1990 |

* cited by examiner

*Primary Examiner*—Ed Tolan
(74) *Attorney, Agent, or Firm*—Herbert Dubno

(57) ABSTRACT

A drawing apparatus is assembled from modular units utilizing modular path-forming members and holder modules which can carry the drawing die and drawing carriages shiftable on the guide modules. The drives for the carriages are individual linear motors whose stationary components are the modular path-forming members disposed end-to-end.

10 Claims, 4 Drawing Sheets

MODULAR DRAWING APPARATUS AND DRAWING

FIELD OF THE INVENTION

Our present invention relates to a drawing device for the drawing of elongated material, especially with cross section reduction in a drawing stage of a drawing line. More specifically, the invention relates to the drawing of elongated metal workpieces from billets or bars utilizing a drawing device having at least one drawing carriage, a drive for the carriage and, if appropriate, a drawing die for shaping and reducing the cross section of the workpiece.

BACKGROUND OF THE INVENTION

Drawing machines are used for the drawing of elongated metal workpieces like tubes, bars or rods, through a tool or die with reduction in cross section at the tool and, if desired, shaping of the workpiece to a particular profile. The workpieces can be referred to as structural shapes or as profiles. Drawing machines of the type described can be so-called continuous drawing machines in which the length of the workpiece can be many times greater than the length of the machine and the workpiece can emerge more or less continuously. Drawing machines can also be discontinuous drawing machines capable of drawing a workpiece of only a limited length and sometimes referred to as drawing benches.

One example of a continuously working linear drawing machine is found in DE 28 52 071. This patent document discloses a carriage-type drawing machine in which two drawing slides or carriages are moveable parallel to the drawing direction along a guide on a machine frame. These carriages are movable back and forth and are provided with means for engaging the workpiece in a hand-to-hand mode so as to pull the workpiece more or less continuously through the die. The hand-to-hand machine is generated by double-arm levers which are connected to the slides or carriages and themselves are controlled by a double-curve cam which produces the back and forth motion of each carriage.

Another driving system for a drawing machine is disclosed in European patent document EP 0 371 165 which provides a rotating drum which has a cam formation in the form of a rib of its periphery to produce the opposite movements of the drawing slides or carriages. The short strokes of the curves means that each stroke will consist basically and predominantly of an acceleration segment and a braking segment. To ensure operation with a high mean drawing speed, a very high stroke frequency should be used. The stroke frequency, however, cannot be increased without limits since it is restricted by the fact that there is significant inertia at the reversal points.

In drawing processes which involve a plurality of drawing machines in succession and reduce the cross section of a workpiece in a number of stages, it is customary to reel up the driven product at the end of the drawing line. For this purpose, the drawing machines must be coupled together (see European patent document EP 0 182 922 A1). This can be achieved with a buffering of the length of the workpiece between drawing stages, e.g. by deflecting the workpiece out of its linear lie between the output side of one machine and the input side of the next machine.

When two or more such drawing machines are used together with loop-type buffering of the length of the workpiece, it is necessary in prior art systems to impart a bend to the workpiece which may impose requirements on the further processing. This applies also to systems in which the workpiece may be reeled or wound up between stages.

OBJECTS OF THE INVENTION

It is, therefore, the principal object of the present invention to provide a drawing machine, device or unit which is simple and thus of low capital cost, can be used effectively in drawing lines having multiple units and can have a high production rate with minimum operating and capital cost.

Another object of this invention is to provide an apparatus for drawing an elongated workpiece which represents an advance over the prior art systems described.

Another object of this invention is to provide a drawing apparatus which is free from drawbacks of prior art systems including those mentioned earlier.

SUMMARY OF THE INVENTION

These objects and others which will become apparent hereinafter are achieved in accordance with the invention in a modular drawing apparatus for drawing an elongated workpiece, especially a metal workpiece, which comprises:

- at least one elongated path-forming module alignable contiguously and directly with others of the path-forming modules to define an uninterrupted elongated travel path;
- at least one holder module engaged with the at least one elongated path-forming module and constructed and arranged for selective attachment to the others of the path-forming modules;
- a drawing die mounted in the at least one holder module; and
- a drawing carriage provided with a device engageable with the workpiece and a part carrying the device and displaceable along the path relative to the at least one elongated path-forming module, the part and the path-forming module forming mutually interactive elements of a linear motor for direct displacement of the carriage along the path.

The drawing line embodying the invention can comprise two drawing apparatuses as described in respective drawing stages and located directly abutting one another contiguously along an aforementioned path.

According to the invention the drawing unit or puller for the workpiece is assembled in a modular manner from a plurality of modules which can be identical to one another and utilized interchangeably. These modules include at least one path-forming module which can be joined directly to at least one other path-forming module to form a continuous linear path along the drawing line. The term "directly connectable" is here used to signify that the path-forming modules adjoin one another in a direct end-to-end relationship without any intervening elements and are coupled together so as to be contiguous in their adjoining regions.

The apparatus includes at least one holder module for fastening a drawing die to the drawing unit. The holder module, which can be used interchangeably with other holder modules and can receive any of a number of dies which may be used in succession along the line, has formations which are complementary to those of each path-forming module so that any one of the path-forming modules may receive such a holder module, preferably at an upstream end thereof with respect to the drawing direction. According to the invention the drive means for the drawing carriage is a linear motor with the part carrying the workpiece clamp to the drawing carriage and the path-forming module constituting mutually interactive elements of the linear motor which directly displaces the carriage along the path.

The linear motor referred to herein is an inductive electrical linear motor of the type in which one of the elements forms the so-called stator and which is relatively stationary while the other element forms the armature and is linearly-shiftable by the inductive forces which are generated.

The coils for producing the electromotor force can be provided on one of the elements and the magnetic fields coil can produce eddy currents in the other element so that the magnetic field thereby induced can react with the electromagnetic field to provide the linear force along the path displacing the carriage to draw the workpiece through the die.

Since the drawing unit of the invention is itself of modular construction and is comprised of individual path-forming modules which can be joined together to form the path and in its simplest form has only one such path-forming module, each path-forming module can have a holder module for receiving a respective die. The holder module can be removed from the path-forming module and inserted interchangeably into a path-forming module further downstream. In addition the die may be removably mounted in the holder module. The result is a construction in which holder modules may be provided anywhere along the path and the retaining formations for the holder module can be located at various locations along each path-forming module so as to provide a drawing apparatus of a higher degree of versatility.

Thus for example, any path-forming module can be equipped with one or more holder modules and not every holder module need contain a holder module or die. The drawing device will also include at least one drawing carriage forming the linear motor with the path and thus the travel path itself forms part of the linear motor.

Apart from the modular construction of the drawing unit itself, each linear motor drive for a respective drawing carriage can be of modular construction so that a linear motor can encompass a linear motor complex for a drawing carriage that includes one or more linear motor units. As noted, one such linear motor unit will have a primary and secondary. The primary, of course, including the coils for generating the electromagnetic field in response to electrical energization of the stationary part, either the primary or the secondary, of the respective linear motor unit is integrated in the path-forming module. The movable part is connected with the carriage and will be the other of the secondary and primary. Depending upon the power required for the respective drawing carriage, the linear motor complex will have an appropriate number of linear motor units.

The module construction of the drawing device and the module construction of the linear motor drive for each carriage can be variably assembled for each drawing unit so that a large variety of configurations with different drawing capacities for different products to be drawn can be assembled at minimum cost for construction, assembly and operation.

The path-forming module can be so configured that it is capable of direct connection with at least one further path-forming module to a continued path for the carriage. The drawing unit can thus be assembled to any requisite length and can accommodate a number of drawing carriages displaceable with the same stroke or so as to provide a greater stroke to one or a lesser number of drawing carriages.

The use of a linear electric motor, eliminates the need to limit the stroke length for travel of each individual carriage. Linear motors provide exact control or regulations of the pull on the workpiece, provide rapid acceleration and rapid braking. The use of a greater stroke means that the average speed will be greater since the acceleration and braking segments can be proportionally smaller. It is therefore possible to operate the respective carriages in the forward and rearward movements with different speeds and thus bring each carriage back more quickly into a position in which it engages the workpiece for the pulling operation.

Preferably the stationary secondary of the linear motor drive for the respective drive carriage is configured as a central rail whereby the drawing carriage is displaceable on outer guide rails. Alternatively the stationary secondary part can be formed as two parallel outer rails of a track module and the guide can be formed as the middle rail. Preferably, moreover, this guide is also a modular construction from a plurality of individual guide modules which are assembled together to form the guide. In this manner the path or guide of a drawing unit, depending upon desire, can be extended or shortened as a function of the number of drawing carriages used.

The length of a path-forming module can correspond, according to the invention, to the length of a guide module to allow a change in the length of the line with a minimum of expense.

The individual path-forming modules, by analogy to the individual guide modules, can all have the same length or can be of different lengths, each a whole number of times a modular length. In this manner the operator can determine which individual modules of a unit must be assembled together to satisfy any particular requirement. The guide module lengths can be matched to the path-forming module lengths.

The individual path-forming modules, as has been noted, can be provided with formations to allow holder modules to be mounted at various locations along the length of the path-forming module and thus to allow the placement of the die at either of several locations in the path-forming module. The formations or arresting parts of the holder modules can be projections which engage in grooves of the path-forming module to allow positioning of the dies where desired.

The invention also is a drawing line of modular construction which itself is formed of at least two drawing units each comprising at least one path-forming module and at least one and preferably two drawing carriages and a holder module for at least one die. The line can thus comprise a continuous path through which the workpiece is drawn in two or more stages.

By contrast to prior art systems as has been described, the two drawing units are directly adjacent one another, i.e. contiguous and the drawing carriages of the two units are operated independently or in a coupled relationship to eliminate the need for a buffer loop, in spite of the fact that the downstream unit must operate at a linear speed greater than that of the upstream unit. For this purpose the drawing line has a computer for controlling the linear motor of the respective drawing units and signal lines for transmitting power to the respective linear motor or carriages or for transmitting inputs to the computer to coordinate the back and forth movement carriages and thus to coordinate the movements of the carriages in the two units with one another. The modular construction, of course, allows a high versatility in creating the drawing line.

The linear motor drive of the respective slides can be so precisely and individually controlled that there is no need at all for buffer zones. The result is a cost saving in addition to the increased compaction of the overall line since neither buffer zone or compensating or equalizing zones are required. Most workpieces can be fabricated in a single pass through a number of stages.

It is especially preferred to assemble the modules into a drawing line with combined predrawing and drawing carriages which in a first stage effect a predrawing step and in a subsequent stage a main drawing operation alone or in combination with further drawing carriages.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
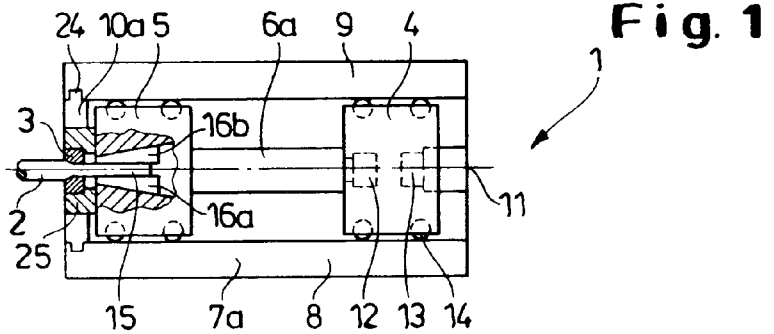
FIG. 1 is a diagram, partially in sections showing a basic drawing unit of the invention encompassing one path forming the module, a predrawing carriage and a main drawing carriage.

FIG. 1 shows a drawing unit for the drawing of elongated workpieces 2 so as to effect a cross sectional reduction and, if desired, a change of shape in a die or other drawing tool 3. For this purpose, the drawing unit comprises a drawing carriage 4 and a predrawing carriage 5.

The drawing unit 1 is formed with a modular construction and comprises a path-forming module 6*a* in the form of an elongated metal rail which can be mounted in a frame structure, housing or the like or which can be constituted by a frame structure, housing or the like. The drawing unit also includes a guide module 7*a* in the form of two outer guide rails 8, 9 and a holder element module 10*a* which can be releasably affixed between the two guide rails 8, 9 of the guide module 7*a*.

The holder element module 10*a* is formed with arresting parts 24, e.g. projections which engage in the guide rails 8, 9 and has a holder part 25 which receives and surrounds the die 3, here a die ring.

The holder part 25 can be releasably mounted in the arresting part 24 and can be set in place with or without its die ring.

Figure 2:
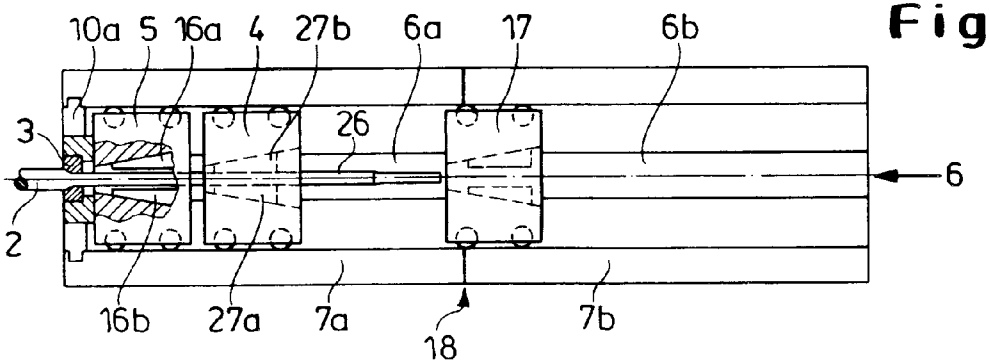
FIG. 2 is a view similar to FIG. 1 of a system having two directly connected path-forming modules and one further drawing carriage.

The path-forming module 6*a* is so equipped that its path end, here its free end 11, can be directly fastened to further path-forming module 6*b* in contiguous or in uninterrupted manner so that the two path-forming modules 6*a*, 6*b* form a continuous path 6 (see FIG. 2). Path 6 or the individual path-forming modules 6*a*, 6*b* form a stationary secondary of a linear electric motor complex constituting a drive means for the predrawing carriage 5 and the drawing carriage 4. The path-forming module 6*a*, 6*b* can also be constructed in modular fashion from a plurality of parallel segments which lie adjacent one another and are assembled together.

The primary part of the linear motor is connected to the carriages 4, 5. In the illustrated system several primary parts 12, 13 are located on the underside of the drawing carriage 4 and are shown in broken lines since they are covered by the portion of the carriage shown. These primary parts interconnect with the path-forming segment 6*a* or the middle rail electromagnetically and can include electrically energizable magnetic coils which induce eddy currents in the rail. These eddy currents, in turn, react with the magnetic fields of the coils to produce the linear reaction force which drives the carriage. As a result, the linear motor displaces each carriage back and forth along the guide rails 8, 9 in the drawing direction and opposite to the drawing direction. The individual carriages can be provided with rollers 14 which enable them to roll along the guide rails 8 and 9.

FIG. 1 shows a drawing unit of a drawing machine in which the workpiece 2, here a tube, is drawn discontinuously in segments through the die 3 by the back and forth displacement of the drawing carriage 4 with short strokes in which the clamp of the drawing carriage 4 can engage a predrawing portion of the tube periphery at the stem 16 of the workpiece which has been forced through the die. Each carriage, for this purpose, can include wedge-shaped clamping jaws 16*a*, 16*b* or 27*a*, 27*b* which release as the carriage is shifted to the left and tighten as the carriage is shifted to the right to allow successive parts of the workpiece to be gripped and pulled through the die. The predrawing carriage 5 need not necessarily be provided with an electric linear motor but can, for example, be formed with a hydraulic drive as may be required.

Where it is desired to operate with a greater stroke for the drawing operation, additional path-forming modules may be added (see FIG. 2) to allow the path to be selected and the stroke of the carriage adjusted in accordance with requirements. The additional modules permit a certain length of the workpiece to be drawn as in the drawing bench in a single stage reduction. Thus the drawing unit of FIG. 2 differs from that of FIG. 1 in that it includes the second path-forming module 6*b* as well as a second guide module 7*b* and at least one further drawing carriage 17. The die 3 is still located at the upstream end of module 6*a* and the upstream portion 18 of the path-forming module 6*b* are so configured that they are connected contiguously and without an interruption into the continuous path 6. The same applies to the guide modules 7*a*, 7*b*. In this embodiment two drawing carriages 4,17 are provided which are operated in a hand-to-hand operation in which the carriage 4 returns to its starting position when the second carriage 17 takes over the drawing operation and vice versa. This provides a continuous drawing machine for long tube and rod drawing.

Figure 3:
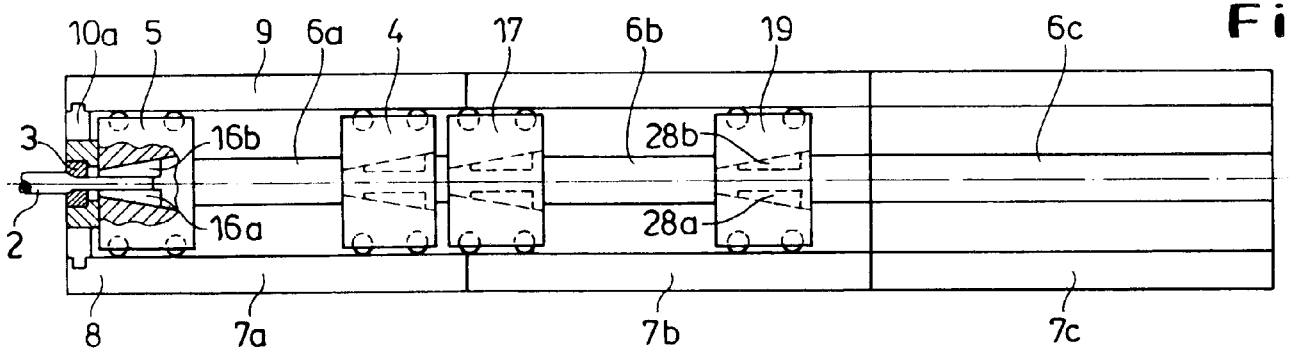
FIG. 3 is a view similar to FIG. 2 with still another path-forming module directly connected to the first two and having two additional drawing carriages behind that shown in FIG. 1.

FIG. 3 shows a further stage in assembling the modular elements of the drawing device of FIGS. 1 and 2 and in this construction a third path-forming modular element 6*c* is added to the path and the drawing machine has three drawing carriages 14, 17 and 19. The guide for the carriages is also extended by a third guide module 7*c*.

These three drawing carriages 4, 17, 19 operate in a process in which always two drawing carriages, as a pair, are engaged with the workpiece for the pulling operation while the third drawing carriage is decoupled from the workpiece and is shifted back to the left into a starting position.

In that case, the stem 15 of the workpiece which projects through the die 3 and is engaged initially by the predrawing carriage 5 and 6 and clamping jaws 16*a*, 16*b* to be pulled to the right in a predrawing operation. The predrawing carriage 5 is then returned to the left, leaving the stem 5 projecting beyond it and the first two drawing carriages are engaged with the stem in their left-hand positions and pull the workpiece to the right. When the carriage 17 is proximal to the carriage 19, the carriage 4 is shifted to the left back to its starting position and the workpiece is engaged by the pair of carriages 17 and 19 which pull the workpiece further to the right.

The clamps of the carriages 4, 17 and 19 all engage the periphery 26 of the workpiece or tube for the further pulling operation. When three drawing carriages are used, the drawing force is increased substantially over systems as in FIGS. 1 and 2 in which only one drawing slide operates at a time since the workpiece is always pulled by two carriages.

Figure 4:
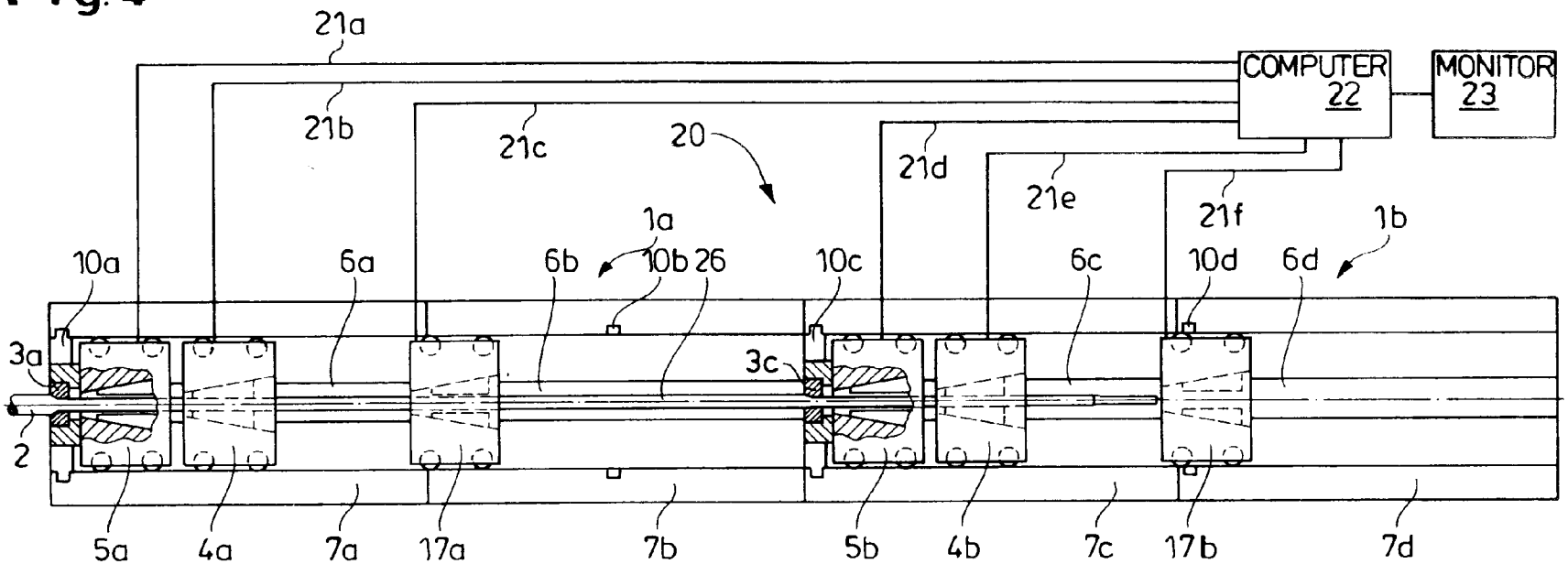
FIG. 4 is a diagrammatic view partly in section of a drawing line with two drawing units each formed as in FIG. 2 and directly adjoining one another.
Figure 5:
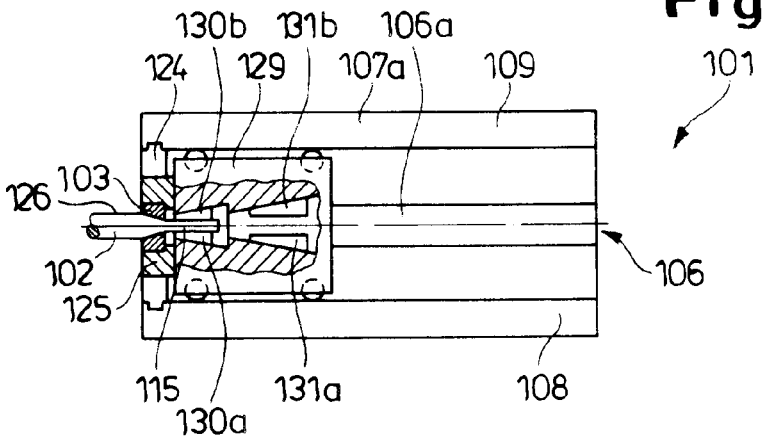
FIG. 5 is a diagram, partly broken away of a drawing unit with a path-forming module in accordance with a second embodiment of the invention having a single carriage for combined predrawing and main drawing.
Figure 6:
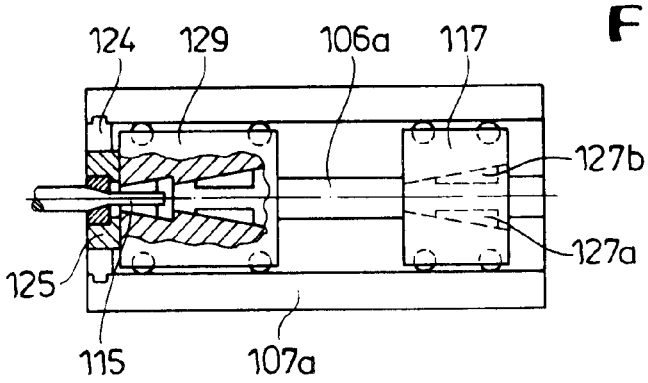
FIG. 6 is a view similar to FIG. 5 with a second drawing carriage.

FIG. 4 shows an embodiment of a drawing line 20 which is comprised of two drawing units 1*a*, 1*b*, each of which has two path-forming modules as shown in FIG. 2 and each of which has a respective drawing die 3*a*, 3*c* secured in a modular holder 10*a*, 10*c* anchored in formations in the end of the respective guide or path-forming modules.

In effect, therefore, a unit of the type shown in FIG. 3 is followed by a fourth path-forming module 6*d* and guide modules 7*d*. However, by contrast to the embodiment of FIG. 3, the third guide module 17 has a holder module 10*c* inserted therein to carry the second drawing die 3*c*. Each drawing unit has a predrawing carriage 5*a*, 5*b* and two drawing carriages 4*a*, 4*b*; 17*a*, 17*b* as has been illustrated in FIG. 2 for hand-to-hand operation. 10*b* represents a further set of grooves in the module 7*b* which can accommodate yet another holder module and die, if desired. The formations 10*b*, like the formations 24 shown in FIG. 1, can be provided at the ends, center or elsewhere on the guide modules 7*a*–7*d* so as to indicate that the holders may be disposed selectively anywhere along the path.

The individual carriages can be controlled via signal lines 21*a*–21*f* by a computer unit 22 to control the direction and power of the respective linear motors and thereby control with precision the movements of the carriages as to speed, position and force and bring about the hand-to-hand operations as described. The computer can have a monitor 23 to allow data and positions to be monitored by the operator.

Figure 7:
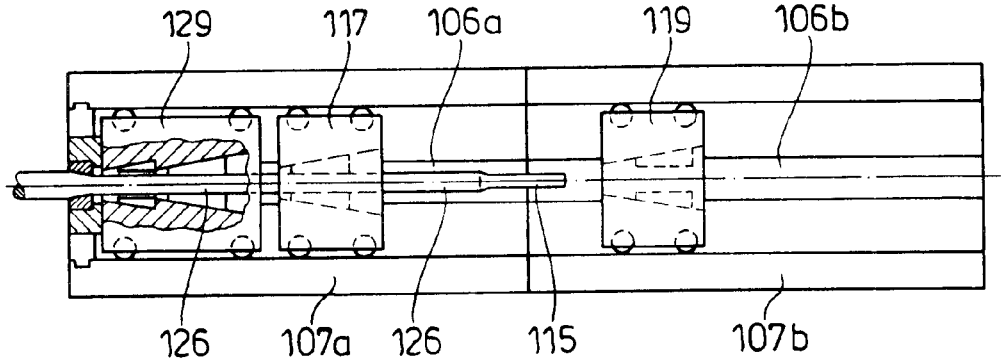
FIG. 7 is a view of the assembly of FIG. 6 to which another path-forming module is joined which is provided with a third carriage.

FIGS. 5–8 show pulling units and a drawing line in accordance with a second embodiment of the invention in which combined predrawing and drawing carriages 129 are used. These carriages are referred to herein as "combi-carriages". The drawing unit 101, like the drawing unit of FIG. 1 is assembled from modular components analogous to those of FIG. 1. The combi-carriage 129 has two different clamping jaw pairs 130*a*, 130*b* and 131*a*, 131*b*, the first pair engaging the stem 115 and the second pair engaging the body 126 of the tube 102 for drawing the same through the die. After the combi-carriage has drawn a short length of the workpiece tube through the die, it is returned to the left and the second clamping jaw pair 130*a*, 130*b* engages the body of the tube and begins the drawing process. After a short stroke, the combi-carriage is returned to the left and the workpiece can be engaged by a second drawing carriage 117. The path can be lengthened by additional modules 106*b*, 107*b* as shown in FIG. 7 and additional drawing carriages 119 can be provided as well. The combi-carriage 129 can be displaced back and forth with only a small stroke.

Figure 8:
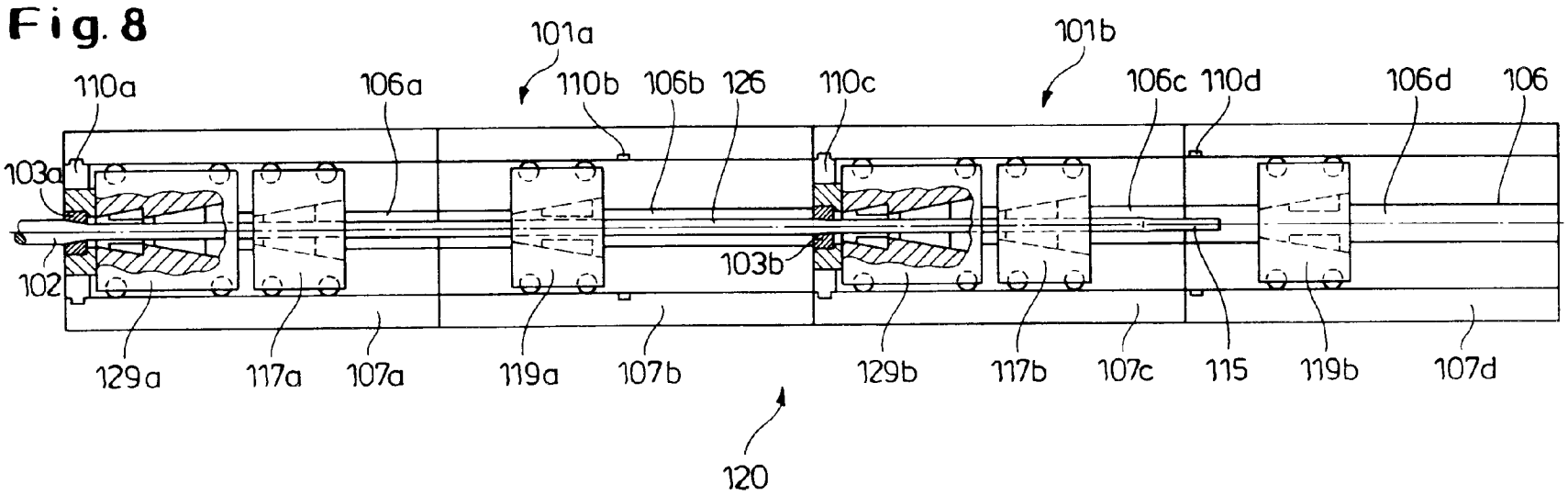
FIG. 8 is a view similar to FIG. 4 of a drawing line having two drawing units in accordance with FIG. 6 each with a combined predrawing and drawing slide and one further drawing slide.

The system of FIG. 7 has the advantage of enabling significant lengths of the workpiece to be drawn after only a few small strokes of the combi-carriage to advance a sufficient length of the workpiece for engagement by the additional carriages 117 and 119. FIG. 8 shows a drawing line 120 with two drawing units 101*a* and 101*b* of the type shown in FIG. 7 and thus with four path-forming modules 106*a*–106*b* and guide modules 107*a*–107*d* and a total of two drawing dies 103*a*, 103*b* and two holding modules 110*a*, 110*c* but with formations 110*b* and 110*d* for additional holding modules.

In FIG. 8 the workpiece is shown to have been drawn through the second die and ready to be engaged by the last carriage 119*b*. A computer analogous to that shown in FIG. 4 controls the linear motors of the carriages 117*a*, 117*b*, 119*a*, 119*b* and 129*a*, 129*b*.

As desired the number of carriages can be increased further and the carriages can draw the workpiece in pairs to increase the drawing force. The drawing path can be increased by the addition of further modules and thus, utilizing the modular-assembly technique, the length of the line, the placement of the dies, the drawing force, the dimensions of the workpiece drawn and the like can all be varied easily.

We claim:

1. A modular drawing apparatus for drawing an elongated workpiece, said apparatus comprising:

at least one elongated path-forming module alignable contiguously and directly with others of said path-forming modules to define an uninterrupted elongated travel path;

at least one holder module engaged with said at least one elongated path-forming module and constructed and arranged for selective attachment to said others of said path-forming modules;

a drawing die mounted in said at least one holder module; and a drawing carriage provided with a device engageable with said workpiece and a part carrying said device and displaceable along said path relative to said at least one elongated path-forming module, said part and said path-forming module forming mutually interactive elements of a linear motor for direct displacement of said carriage along said path, said linear motor encompassing at least one linear motor unit having a stationary part forming one of said reactive units and integrated in said path-forming module, said linear motor having a primary part and a secondary part, and said path-forming module encompassing one of said parts and the other of said parts being connected with said drawing carriage, the secondary part being formed as a middle rail or two parallel outer rails of the path-forming module, said path-forming module being directly connected in-line to another path-forming module, corresponding rails of said path-forming modules being connected contiguously with one another.

2. A modular drawing apparatus for drawing an elongated workpiece, said apparatus comprising:

at least one elongated path-forming module alignable contiguously and directly with others of said path-forming modules to define an uninterrupted elongated travel path;

at least one holder module engaged with said at least one elongated path-forming module and constructed and arranged for selective attachment to said others of said path-forming modules;

a drawing die mounted in said at least one holder module; and a drawing carriage provided with a device engageable with said workpiece and a part carrying said device and displaceable along said path relative to said at least one elongated path-forming module, said part and said path-forming module forming mutually interactive elements of a linear motor for direct displacement of said carriage along said path, a plurality of said path-forming modules being connected contiguously together to form said path, a plurality of said carriages being provided along said path, said carriages being displaceable on a guide assembled in a modular construction from a plurality of guide modules.

3. The modular drawing apparatus defined in claim 2 wherein the length of a path-forming module corresponds to a length of a respective guide module.

4. The modular drawing apparatus defined in claim 2 wherein the path-forming modules are all of the same lengths.

5. The modular drawing apparatus defined in claim 2 wherein the path-forming modules are of different lengths.

6. The modular drawing apparatus defined in claim 2 wherein said holder module has an arresting part connected with said guide, and a holding part surrounded by said arresting part for selective insertion and removal of said die.

7. A drawing line for drawing an elongated workpiece, comprising at least two modular drawing units, each of said drawing units comprising at least one drawing slide engageable with said workpiece, at least one elongated path-forming module alignable contiguously and directly with others of said path-forming modules to define an uninterrupted travel path, at least one holder module engaged with said at least one path-forming module of the respective unit and constructed and arranged for selective attachment to others of said path-forming modules, a respective drawing die mounted in each holder module whereby said workpiece traverses said dies, and a respective drawing carriage provided with a device engageable with said workpiece and a part carrying said device, said carriages being displaceable in the respective path-forming modules, said part and path-forming module of each unit forming mutually interactive elements of respective linear motors for direct displacement of said carriages along said path, the path-forming modules of each unit being directly in line with and connected to the path-forming modules of the other unit, and a computer for controlling the linear motors and movement of the respective carriages for coordinated drawing of the workpiece through the dies without buffering of the workpiece between said units.

8. The drawing line defined in claim 7 wherein the holder module of a downstream one of said units is located immediately downstream of a path-forming module of an upstream one of said units.

9. The drawing line defined in claim 7 wherein each of said units has a combined carriage with predrawing and main drawing portions.

10. The drawing line defined in claim 7 wherein each of said units has a predrawing carriage followed by a main drawing carriage.

* * * * *